US005603544A

United States Patent [19]

Bishop et al.

[11] Patent Number: 5,603,544

[45] Date of Patent: Feb. 18, 1997

[54] COMPRESSION CAP ASSEMBLY FOR SPREADER PIPE

[75] Inventors: David J. Bishop; James R. Plair, both of Houston, Tex.

[73] Assignee: Maxibar, L.P., Houston, Tex.

[21] Appl. No.: 487,894

[22] Filed: Jun. 7, 1995

[51] Int. Cl.[6] ..... B66C 1/12

[52] U.S. Cl. ..... 294/81.1; 294/81.5

[58] Field of Search ..... 294/1.1, 67.1, 294/67.3, 67.4, 67.41, 81.1, 81.21, 81.3, 81.4, 81.5, 81.55, 81.56, 74, 82.11

[56] References Cited

U.S. PATENT DOCUMENTS

| | | | |
|---|---|---|---|
| 3,021,166 | 2/1962 | Kempel et al. | 294/74 |
| 3,519,302 | 7/1970 | Drenstein | 294/74 |
| 4,092,038 | 5/1978 | Harris | 294/82.11 |
| 4,215,891 | 8/1980 | Thiele | 294/81.1 X |
| 4,397,493 | 8/1983 | Khachaturian et al. | 294/81.1 |
| 4,538,849 | 9/1985 | Khachaturian et al. | 294/81.1 |

*Primary Examiner*—Johnny D. Cherry
*Attorney, Agent, or Firm*—Bush, Moseley, Riddle & Jackson

[57] ABSTRACT

A compression cap assembly for the end of a spreader bar or pipe used in lifting heavy loads with a crane includes a compression plate, spaced-apart plate members on the outer side of the compression plate that carry upper and lower pins that extend through loops on the ends of cables, and semi-circular coupling members on the inner side of the compression plate that receive an end portion of the spreader pipe. The coupling members having clearance between the adjacent edges thereof, and fasteners are used to reduce the clearance and cause the coupling members to tightly clamp and grip such end portion.

8 Claims, 1 Drawing Sheet

FIG. 1
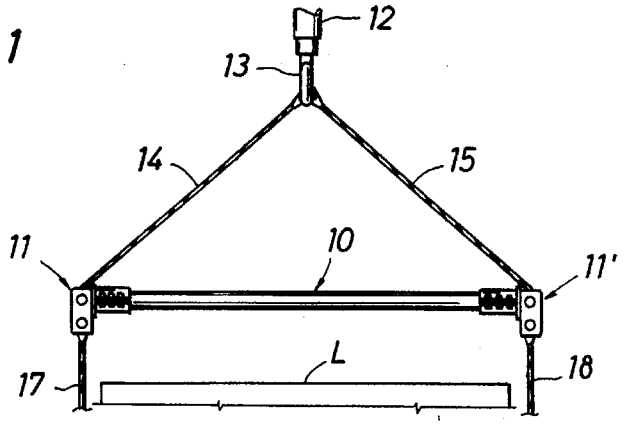
FIG. 2
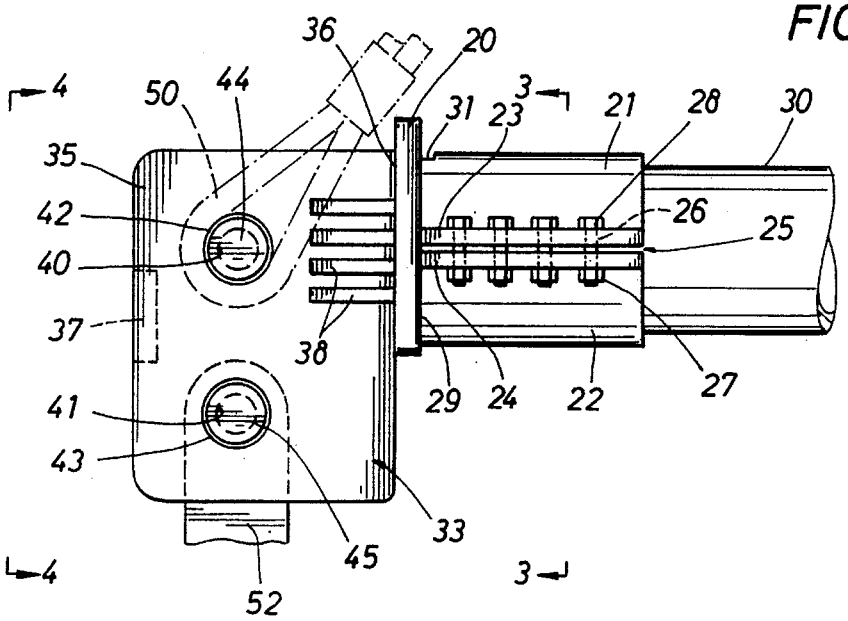
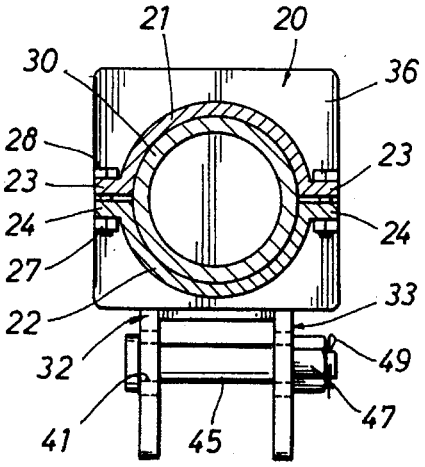
FIG. 3
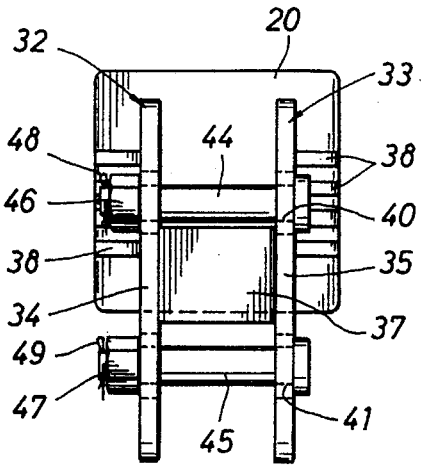
FIG. 4

COMPRESSION CAP ASSEMBLY FOR SPREADER PIPE

FIELD OF THE INVENTION

This invention relates generally to spreader bars or pipe used in lifting various heavy loads by a rigging of cables suspended from a crane, and particularly to a new and improved compression cap assembly that is easily installed on the end of a spreader pipe and simplifies the rigging while minimizing weight.

BACKGROUND OF THE INVENTION

When using a crane and a system of cables to lift, and otherwise handle heavy loads such as boats, pressure vessels, refinery components and various modules used in the fabrication of offshore drilling rigs and the like, it is a typical practice to use one or more horizontal spreader pipes or bars to control the geometry of the lifting cables. For example one pair of equal length cables may incline in opposite directions from the hook and traveling block to the respective outer ends of the spreader bar, while another pair of such cables extend vertically from the respective outer ends of the bar to the load being lifted. The spreader bar protects the load by keeping the cables away from it during lifting. To increase the number of lift points, other cable and spreader bar sets can be suspended from the ends of an upper spreader bar and form a cascade of lifting units at right angles to one another with the lowermost cables being vertical and coupled at spaced points to the load. When the load is picked up, each spreader bar is placed under high compression loading as it maintains the separation between the lower ends of the inclined cables above it.

The compression end cap assemblies by which the cables are connected to a spreader bar or pipe are a very important component in the design of the above type of lifting equipment, because failure of a cap or buckling of a spreader pipe can cause a potentially disastrous situation to exist. Although a number of different types of cap designs have been used, problems remain. For example, a known design requires the use of shackles for each cable connection point, which are quite heavy and expensive and increase rigging time. Any change in spreader span or length in the field requires welding which is time consuming and expensive. Some spreader bar designs have not been reusable or adaptable to other lifting situations, were difficult to rig up, and could require an extra crane for their handling.

An object of the present invention is to provide a new and improved compression cap assembly for a spreader bar that obviates the above-mentioned problems.

Another object of the present invention is to provide a new and improved compression cap assembly that eliminates the need for using shackles or similar connecting devices, together with their extra weight.

Still another object of the present invention is to provide a new and improved compression cap assembly that is much easier to install on the end of a spreader pipe, thereby minimizing down time.

Yet another object of the present invention is to provide a new and improved compression cap assembly that is constructed and arranged to permit change in spreader bar span in the field without time consuming and expensive fabrication including welding.

SUMMARY OF THE INVENTION

These and other objects are attained in accordance with the concepts of the present invention through the provision of a compression cap assembly adapted to be secured to the end portion of a spreader bar or pipe and including a compression plate member having a pair of spaced-apart, parallel load plates fixed to the outer side thereon and a pair of opposed, semi-circular sleeve members fixed to the inner side thereof. The sleeve members have a selected clearance between the adjacent edges thereof, and flanges that extend outwardly along such edges. A plurality of regularly spaced, aligned bolt holes are provided in such flanges, and a corresponding plurality of bolts extend through the holes. The clearance is such that the end portion of a spreader pipe can be inserted easily into the socket provided by the sleeve members and butted up adjacent the compression plate. Then the bolts are tightened to reduce the clearance and cause the sleeves to rigidly clamp and grip the end portion.

The load plates have upper and lower sets of aligned holes therein which respectively receive a connecting pin that goes through a loop in the end of a lift cable, although a thimble S also can be used. The central axis of the upper set of holes intersects the longitudinal axis of the end portion of the spreader pipe. A spacer extends between the outer edges of the load plates to maintain fixed separation therebetween. If a different type of lower cable connection is desired, an elongated link plate having upper and lower support pin holes can be pivoted to the lower pin and extend downward to where a connection such as a shackle can be coupled thereto. If desired, several reinforcing gussets can be welded on the outer sides of the load plates and to outer edges of the compression plate to increase the strength thereof, particularly when lifting heavier loads.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 1 is a schematic view of a load lifting sling having a spreader pipe or bar with compression cap assemblies in accordance with the invention;

FIG. 2 is an enlarged side elevation view of a compression cap assembly shown in FIG. 1;

FIG. 3 is a cross-section on line 3—3 of FIG. 2; and

FIG. 4 is an end view on line 4—4 of FIG. 2.

DETAILED DESCRIPTION OF A PREFERRED EMBODIMENT

Referring initially to FIG. 1, a rigging arrangement of cables for lifting a heavy load L with a crane (not shown) includes a spreader bar or pipe 10 having compression cap assemblies 11, 11' in accordance with the invention secured to each end thereof. The rigging includes a traveling block 12, a hook 13 and a pair of upper cables 14, 15 whose upper ends are coupled to the hook 13. The lower ends of the cable 14, 15 are connected to the respective cap assemblies 11, 11', and are held spread apart by the bar or pipe 10. Additional cables 17, 18 extend vertically downward from the respective cap assemblies 11, 11' to points of attachment to the load L, which can be, for example, on the base or platform thereof. In this manner the cables 17, 18 are held clear of the load L and will not damage it as it is lifted and positioned. The upper cables 14, 15 and the spreader pipe 10 form an equilateral or an isosceles triangle, and together with the lower cables 17, 18 form a basic lifting unit that provides two lift points. Additional lift points can be provided by suspending additional units from the cap assemblies 11, 11' which are oriented at 90°, and more units can be cascaded in a symmetrical pattern so that the total number of lift points is twice the number of units. When the load L is picked up/all the cables 14, 15, 17, 18 are placed in tension and the spreader 10 is placed in compression. Of course, the spreader 10 is designed to avoid any buckling under expected loads, and preferably is made of thick-walled seamless pipe or the like. With the load L appropriately elevated, it is swung around by the crane and then lowered into position. As noted above, the load L might be any one of the various modular components used in the fabrication and assembly of an offshore production platform, in which case the components usually are floated out to the site on a barge and then lifted by a crane on a lift boat from the barge onto the platform. Of course, a production platform can be disassembled and salvaged in the same way. Numerous heavy loads L can be handled in this manner, including various boats or vessels, as well as pressure tanks and large refinery components, to mention but a few.

A compression cap assembly 11 or 11' that is constructed in accordance with the present invention is shown in detail in FIGS. 2–4. Each assembly includes a thick, very strong, rectangular or square metal compression plate 20 having a pair of coupling members 21, 22 welded to the inner face 29 thereof. Each member 21, 22 is generally semicircular and has longitudinal, outwardly directed flanges 23, 24 formed along each side edge thereof. The members 21, 22 are attached on the plate 20 in a manner such that a selected clearance space 25 is formed on each side between the opposed faces of the flanges 23, 24. A series of aligned bolt holes 26 are formed in the flanges 23, 24 which receive bolts 27 having nuts 28 that can be tightened in order to draw the members 21, 22 together and thereby clamp the members forcefully around the end portion 30 on the spreader pipe 10. As shown in FIG. 2, the outer end surface of the pipe portion 30 is butted firmly up against the face 29 of the compression plate 20 so that compression loads are transmitted directly from the plate to the pipe. If desired, an arcuate inspection slot 31 can be formed in the outer end of the sleeve 21 to afford a visual confirmation that the pipe portion 30 is up against the plate 20 before the nuts 28 are tightened. It is also within the scope of this invention to form the upper sleeve member 21 to be free of the compression plate 20 and merely clamped down by the bolts 27 and nuts 28, in which case the slot 31 is not needed.

A pair of generally rectangular load plates 32, 33 have the inner sides of their upper sections 34, 35 welded to the outer surface of the compression plate 20 at 36. The inner walls of the plates 32, 33 are spaced a selected distance apart as shown in FIG. 4, and a spacer member 37 is welded between their outer edges about midway of their length. If desired, and particularly for high load capacity service, a series of gussets 38 can be welded to the outer walls of the plates 32, 33 and to the outer faces of the compression plate 20 symmetrically with respect to the longitudinally axis of the spreader pipe end portion 30. Upper and lower sets of holes 40 and 41 are formed in the load plates 32, 33, and tubular bushings 42, 43 are welded in these holes. Connection pins 44, 45 are positioned through the bushings 42, 43 and have retainer nuts 46, 47 threaded onto one end thereof. Cotter pins 48, 49 can be used to prevent back-off. The upper bushings 42 and the pin 44 usually have a somewhat greater diameter that the corresponding lower bushings 43 and pin 45 for greater load bearing capacity.

The pins 44, 45 extend through loops 50 (one shown in phantom lines at upper pin 44) 50, 51 which terminate the ends of the cables 14 and 17, and the plates 32, 33 are spaced to accommodate the widths of at least one of such loops. A loop (not shown) also terminates the upper end of each vertical cable 17, 18 and goes around a pin 45. If it is desired to employ shackles to suspend the vertical lift cables 17, 18, although loops 50 are preferred, a link plate 52 can be provided which has an upper hole through which the pin 45 can be extended. A lower hole (not shown) can be used to connect the typical pin of such shackle. The various parts of each compression cap assembly 11 and 11' are fabricated of alloy steel plate giving a high strength-to-weight ratio, thus reducing the weight of each assembly compared to prior devices of this type. For example, the compression plate 20, the load plates 32, 33, and the gussets 38 can be made of a 514B steel, and the coupling members 21, 22 and the spreader pipe 14 made of ASTM/ASME A 106B seamless pipe. The various bolts and nuts also are made of alloy steel, as are the pins 44, 45.

OPERATION

In operation and use, the compression cap assemblies 11 and 11' are made as shown in the drawings and installed on the end portions 30 of the spreader pipe 10 by sliding the members 21, 22 onto a respective end portion until the end face of the pipe butts up against the compression plate 20. At this point the bottom edges of the load plates 32, 33 are resting on the same surface so that the assemblies 11, 11' are automatically aligned in the same vertical plane. The bolts 27 are positioned and the nuts 28 tightened to reduce the clearance space 25 and cause the members 21, 22 to tightly grip the end portion 30 of the spreader pipe 10. The upper pin 44 is removed temporarily to position the loop 50, and then repositioned through the bushings 42 and secured by the nut 46 and a cotter pin. The same procedure is used to connect the loops on the upper ends of the lower cables 17, 18 to the lower pins 45. The upper loops of the cables 14, 15 are secured to the hook 13, and the rigging can be lifted by the crane and positioned over the load L. The lower ends of the cables 17 and 18 are appropriately connected to the load L, which then can be lifted and positioned as desired. As noted above, additional units including a spreader pipe, compression cap assemblies and cables can be suspended below the cap assemblies 11, 11' to provide additional lift points.

As an illustrative example of the size of the components of the cap assemblies 11, 11', the clamp members 21, 22 can be 1–3 feet long and made from a section of 12 inch schedule 120 pipe, the compression plate 20 made of a 13 inch square steel member that is 1½ inches thick, the load plates 32, 33 each made of a 16½ inches by 23 inches by 1¼ inch thick steel plate, and the spreader pipe 10 made of 10 inch schedule 120 seamless pipe having suitable length. The gussets 38 can each be 1 inch thick by 6 inches long. In the event a link plate 52 is employed, it can be a steel plate that is 6 inches wide and ¾ inch thick.

The present invention has several significant advantages over prior devices. The loops on the cables are connected directly to the pins in the load plates which eliminates the need for shackles or other sling connecting members and the extra weight thereof. The cap assemblies are easily installed on the end portions of a spreader pipe due to the split sleeve or collar design into which the end portions of a spreader are inserted. The construction allows a change in spreader span to be made in the field without welding and with a minimum of expensive downtime. The assemblies have greater strength-to-weight ratios on account of the alloy steels used, while complying in all respects with applicable guidelines and standards for below-the-hook lifting devices. Since certain changes or modifications may be made in the disclosed embodiment without departing from the inventive concepts involved, it is the aim of the appended claims to cover all such changes and modifications falling within the true spirit and scope of the present invention.

What is claimed is:

1. Apparatus adapted to be fixed to the end of spreader means in a cable rigging that is used to lift a load, comprising; a compression plate having inner and outer sides; means on said outer side of said compression plate for attaching the ends of cables included in said rigging; and coupling means on said inner side of said compression plate for securing an end portion of the spreader means thereto, said coupling means including opposed, elongated members sized and arranged to fit over said end portion and having clearance between the adjacent edges thereof, and selectively operable means for reducing the width of said clearance to bring said coupling members into gripping engagement with said end portion.

2. The apparatus of claim 1 where said elongated members are each generally semicircular.

3. The apparatus of claim 2 where each of said generally semicircular members has outwardly directed flanges extending along said edges, and wherein said selectively operable means is a plurality of bolts extending through said flanges and adapted to be tightened to cause said gripping engagement.

4. The apparatus of claim 2 wherein one of said members is fixed to said compression plate and the other of said members is movable relative thereto.

5. The apparatus of claim 1 wherein said attaching means includes a pair of spaced-apart generally rectangular plates having upper and lower portions, said upper portions being fixed to said outer side of said compression plate, said plates having upper and lower aligned holes therein adapted to receive upper and lower pin members, said upper holes having a central axis intersecting the central axis of said end portion.

6. The apparatus of claim 5 wherein said plates are spaced apart a distance to receive a loop on the end of a cable, with one of said pin members passing through the loop.

7. The apparatus of claim 6 further including spacer means holding the outer sides of said plates a fixed distance apart.

8. The apparatus of claim 5 further including a link member having upper and lower holes therein, and positioned such that said lower pin member is received in said upper hole therein.

* * * * *